US010343826B2

(12) United States Patent
Sugiyama et al.

(10) Patent No.: US 10,343,826 B2
(45) Date of Patent: Jul. 9, 2019

(54) CONTAINER LID COMPOSED OF INSIDE PLUG AND LID BODY

(71) Applicant: NIPPON CLOSURES CO., LTD., Tokyo (JP)

(72) Inventors: Takashi Sugiyama, Kanagawa (JP); Osamu Ishii, Kanagawa (JP); Masataka Iyadomi, Kanagawa (JP)

(73) Assignee: NIPPON CLOSURES CO., LTD., Tokyo (JP)

( * ) Notice: Subject to any disclaimer, the term of this patent is extended or adjusted under 35 U.S.C. 154(b) by 943 days.

(21) Appl. No.: 14/763,313

(22) PCT Filed: Feb. 13, 2014

(86) PCT No.: PCT/JP2014/053253
§ 371 (c)(1),
(2) Date: Jul. 24, 2015

(87) PCT Pub. No.: WO2014/132800
PCT Pub. Date: Sep. 4, 2014

(65) Prior Publication Data

US 2015/0368008 A1 Dec. 24, 2015

(30) Foreign Application Priority Data

Feb. 28, 2013 (JP) ..... 2013-039113
Mar. 28, 2013 (JP) ..... 2013-069608
Mar. 28, 2013 (JP) ..... 2013-069609

(51) Int. Cl.
*B65D 47/36* (2006.01)
*B65D 47/08* (2006.01)
(Continued)

(52) U.S. Cl.
CPC ..... *B65D 47/36* (2013.01); *B65D 39/0076* (2013.01); *B65D 47/0838* (2013.01);
(Continued)

(58) Field of Classification Search
CPC ..... B65D 47/36; B65D 51/228
(Continued)

(56) References Cited

U.S. PATENT DOCUMENTS

2011/0056982 A1 3/2011 Swanick

FOREIGN PATENT DOCUMENTS

JP 07-132952 5/1995
JP 2005-59933 3/2005
(Continued)

OTHER PUBLICATIONS

Search report from PCT/JP2014/053253, dated Apr. 8, 2014.

*Primary Examiner* — Anthony D Stashick
*Assistant Examiner* — Raven Collins
(74) *Attorney, Agent, or Firm* — Greenblum & Bernstein, P.L.C.

(57) ABSTRACT

A container lid is composed of a synthetic resin inside plug to be mounted on the mouth of a container, and a synthetic resin lid to be mounted on the inside plug. A breakable thin-walled line formed in a closing wall has an outer arcuate portion extending from a breakage start end portion, and an inner arcuate portion extending from the breakage start end portion, and defines an arcuate deformation region. A locked element is annexed to the deformation region, and a locking element is in the lid. When the lid is rotated in a predetermined direction, the locking element is locked to the locked element. When the lid is rotated further in the predetermined direction, a force is exerted on the deformation region via the locking element and the locked element, so that the breakable thin-walled line of the inside plug is broken and the deformation region is deformed.

19 Claims, 16 Drawing Sheets

(51) Int. Cl.
*B65D 39/00* (2006.01)
*B65D 51/22* (2006.01)

(52) U.S. Cl.
CPC .... *B65D 51/228* (2013.01); *B65D 2251/0025* (2013.01); *B65D 2251/0087* (2013.01)

(58) Field of Classification Search
USPC ..... 215/253
See application file for complete search history.

(56) References Cited

FOREIGN PATENT DOCUMENTS

| | | |
|---|---|---|
| JP | 2012-76775 | 4/2012 |
| WO | 2011/031639 | 3/2011 |

CONTAINER LID COMPOSED OF INSIDE PLUG AND LID BODY

TECHNICAL FIELD

This invention relates to a container lid composed of a synthetic resin inside plug to be mounted on the mouth neck of a container, and a synthetic resin lid body to be mounted on the inside plug.

BACKGROUND ART

Patent Document 1 indicated below discloses a container lid composed of a synthetic resin inside plug to be mounted on the mouth neck of a container, and a synthetic resin lid body to be mounted on the inside plug. The inside plug includes a circular closing wall, and a cylindrical mounting wall connected to the outer peripheral edge of the closing wall. The mounting wall is fitted to the outer peripheral surface of the mouth neck of the container, whereby the inside plug is mounted on the mouth neck of the container, and the closing wall closes the mouth neck of the container . The lid body includes a circular covering wall, and a fitting wall connected to the outer peripheral surface of the covering wall. An internal thread formed in the inner peripheral surface of the fitting wall is screwed to an external thread formed on the outer peripheral surface of the mounting wall of the inside plug, whereby the lid body is mounted on the inside plug, and the covering wall is located above the closing wall of the inside plug. In the closing wall of the inside plug, a breakable thin-walled line is formed which defines a comma-shaped removal region, and a key-shaped locked piece is formed which extends out upwardly from the removal region. On the lower surface of the covering wall of the lid body, a key-shaped locking piece is formed which is locked to the locked piece of the inside plug. With the lid body being mounted on the inside plug as required, the lid body is rotated counterclockwise as viewed from above (in a direction in which the lid body is detached from the inside plug) relative to the inside plug. As a result, a force is exerted on the removal region of the inside plug via the locking piece of the lid body and the locked piece of the inside plug. Thus, the breakable thin-walled line is broken, so that the removal region is removed from the closing wall, whereupon a pass-through opening is formed in the closing wall.

PRIOR ART DOCUMENTS

Patent Documents

Patent Document 1: JP-A-2005-59933

SUMMARY OF THE INVENTION:

Problems to be Solved by the Invention

The above-described container lid disclosed in Patent Document 1 is free from a sanitary problem posed by the contact of fingers with the closing wall of the inside plug. Instead, simply by rotating the lid body relative to the inside plug, the breakable thin-walled line formed in the closing wall of the inside plug is broken to remove the removal region from the closing wall, whereby the pass-through opening can be formed. However, the container lid is still not fully satisfactory, because the removal region separated from the closing wall becomes a so-called waste piece, and such a waste piece enters the container. A complicated treatment method of taking out the waste piece and discarding it, for example, is required in this case. Since the engagement between the locking piece and the locked piece is not necessarily sufficient, moreover, the breakable thin-walled line may fail to be broken as required.

The present invention has been accomplished in the light of the above-mentioned facts. Its principal technical challenge is to provide a novel and improved container lid which can forma pass-through opening in a closing wall of an inside plug without generating a so-called waste piece.

Another technical challenge for the present invention is to provide a novel and improved container lid, which can break a breakable thin-walled line sufficiently reliably as required, in addition to solving the above principal technical challenge.

Means for Solving the Problems

The present inventors conducted in-depth studies and experiments, and have found that the principal technical challenge can be overcome by imparting a unique form to the breakable line to be formed in the closing wall of the inside plug.

According to the present invention, there is provided, as a container lid capable overcoming the above-mentioned principal technical challenge, a container lid comprising a synthetic resin inside plug to be mounted on the mouth neck of a container, and a synthetic resin lid body to be mounted on the inside plug, wherein the inside plug includes a circular closing wall, and a cylindrical mounting wall connected to the outer peripheral edge of the closing wall, and the mounting wall is fitted to the outer peripheral surface of the mouth neck of the container, whereby the inside plug is mounted on the mouth neck of the container, and the closing wall closes the mouth neck of the container, the lid body includes a circular covering wall, and a cylindrical fitting wall connected to the outer peripheral edge of the covering wall, and the fitting wall is fitted to the outer peripheral surface of the mounting wall of the inside plug, whereby the lid body is rotatably mounted on the inside plug, and the covering wall is located above the closing wall of the inside plug, at least one breakable thin-walled line is formed in the closing wall of the inside plug, the breakable thin-walled line has an outer arcuate portion extending from a breakage start end portion, and an inner arcuate portion extending from the breakage start end portion, and an arcuate deformation region is defined between the outer arcuate portion and the inner arcuate portion, locked means is annexed to the deformation region, at least one discharge opening is formed in the covering wall of the lid body, and locking means collaborating with the locked means is disposed on the lower surface of the covering wall, with the lid body being mounted on the inside plug, the locking means is located upstream of the locked means as viewed in a predetermined direction; when the lid body is rotated in the predetermined direction relative to the inside plug, the locking means is locked to the locked means; and when the lid body is rotated further in the predetermined direction relative to the inside plug, a force is exerted on the deformation region via the locking means and the locked means, so that the breakable thin-walled line of the inside plug is broken and the deformation region is deformed, whereby a pass-through opening is formed in the closing wall of the inside plug.

The other technical challenge mentioned above is solved by the features that two or three of the breakable thin-walled lines are formed at equal intervals in a circumferential direction in the closing wall of the inside plug, and two or three of the deformation regions are defined at equal intervals in the circumferential direction, the locked means is composed of a locked piece extending out upwardly from an upstream end part of the deformation region, as viewed in the predetermined direction, and then extending inwardly in a radial direction, and each of the locking means is composed of a locking piece extending downwardly from the lower surface of the covering wall, and then extending in the predetermined direction.

Preferably, each of the locked pieces is composed of a strut portion extending out upwardly vertically from the upstream end part of the deformation region as viewed in the predetermined direction, and an overhanging beam portion extending horizontally in a radially inward direction from an upper end part of the strut portion. It is preferred that a common strut extending out upwardly from the center of the upper surface of the closing wall of the inside plug be disposed in the closing wall, and the radially inward ends of the overhanging beam portions of the respective locked pieces be connected to each other via the common strut. Preferably, each of the locking pieces is composed of a suspending pillar portion extending downwardly from the lower surface of the covering wall, and a protrusion extending arcuately in the predetermined direction from a lower end part of the suspending pillar portion. In a preferred embodiment, two or three of the discharge openings are formed in the covering wall of the lid body in correspondence with the deformation regions and, in a plan view, each of the protrusions is located as a whole within the discharge opening. Advantageously, at least one positioning groove is formed in one of the outer peripheral surface of the mounting wall of the inside plug and the inner peripheral surface of the fitting wall of the lid body, and at least one positioning projection is formed in the other of the outer peripheral surface of the mounting wall of the inside plug and the inner peripheral surface of the fitting wall of the lid body, and the lid body is mounted on the inside plug, with the positioning projection being advanced into the positioning groove, whereby the relative angular position of the lid body with respect to the inside plug is regulated. Preferably, the outer arcuate portion and the inner arcuate portion of the breakable thin-walled line formed in the closing wall of the inside plug extend counterclockwise from the breakage start end portion as viewed from above, and the predetermined direction is a counterclockwise direction as viewed from above. It is preferred that rotation inhibiting means collaborating with each other to inhibit the lid body from rotating relative to the inside plug in a direction opposite to the predetermined direction be arranged in the inside plug and the lid body. Desirably, when the lid body is rotated relative to the inside plug in the predetermined direction by an angle $\alpha$, which is 50 to 60 degrees, the locking means is locked to the locked means, and return rotation inhibiting means, which, when the lid body is rotated relative to the inside plug by an angle $\beta$ being 0 to 20 degrees smaller than the angle $\alpha$ (0 degrees$\leq\alpha-\beta\leq$20 degrees), collaborate with each other to inhibit the lid body from rotating relative to the inside plug in a direction opposite to the predetermined direction, are arranged in the inside plug and the lid body. In the inside plug and the lid body, it is preferred that rotation restricting means be arranged which collaborate with each other to restrict the rotation of the lid body relative to the inside plug in the predetermined direction to an angle $\gamma$ which is 300 to 320 degrees. Furthermore, in the inside plug and the lid body, it is preferred that reverse rotation inhibiting means be arranged which, when the lid body is rotated relative to the inside plug in the predetermined direction by the angle $\gamma$, collaborate with each other to inhibit the lid body from rotating relative to the inside plug in a direction opposite to the predetermined direction.

Preferably, at least an upstream part of the deformation region as viewed in the predetermined direction is inclined gradually upwardly in an upstream direction. Also preferably, a central main portion of the closing wall, except at least the upstream part of the deformation region and a neighborhood thereof, extends horizontally, the deformation region extends horizontally from the downstream end in an upstream direction, as viewed in the predetermined direction, along a horizontally extending site of the central main portion, and then extends in the upstream direction upwardly obliquely up to the upstream end, and a rising surface extending vertically adjacent to the breakage start end portion and upstream parts of the outer arcuate portion and the inner arcuate portion of the breakable thin-walled line defining the deformation region is formed in the central main portion of the closing wall.

In a preferred embodiment, an annular shoulder surface facing upward is formed in the mounting wall of the inside plug, the outer peripheral surface of the mounting wall located below the annular shoulder surface is located radially outwardly of the outer peripheral surface located above the annular shoulder surface, and the fitting wall of the lid body is fitted to a part of the mounting wall above the annular shoulder surface, corresponding shape deformation portions and/or prints are arranged in at least a lower part of the outer peripheral surface of the fitting wall of the lid body and on the outer peripheral surface of the mounting wall below the annular shoulder surface, and the relative relationship between the corresponding shape deformation portions or prints, with the lid body being mounted on the inside plug as required, is changed when the lid body is rotated relative to the inside plug, whereby it is clearly indicated that the lid body has been rotated relative to the inside plug. In a state where the lid body has been mounted on the inside plug as required, at least the lower part of the outer peripheral surface of the fitting wall of the lid body and the outer peripheral surface of the mounting wall of the inside plug below the annular shoulder surface are advantageously nearly flush with each other . Preferably, an outer lid is coupled via hinge means to an upper end part of the outer peripheral surface of the mounting wall of the lid body so as to be pivotable between a closed position where the covering wall of the lid body is covered and an open position where the covering wall of the lid body is exposed, and at least one ridge, which extends continuously in an axial direction so as to span between at least the lower part of the outer peripheral surface of the fitting wall and the outer peripheral surface of the mounting wall below the annular shoulder surface to constitute the corresponding shape deformation portion, is arranged in each of two specific regions each having a width of 30 to 100 degrees in a circumferential direction about a circumferential center which is a site at an angular distance of 90 degrees on each of circumferentially opposite sides from a circumferential center of the hinge means. It is advantageous that the number and/or width of the ridges arranged in one of the two specific regions be different from the number and/or width of the ridges arranged in the other of the two specific regions. Also preferably, an outer lid is coupled via hinge means to an upper end part of the outer peripheral surface of the mounting wall of the lid body so as to be pivotable between a closed position where the covering wall of the lid body is covered and an open position where the covering wall of the lid body is exposed, and at least one flat surface, which extends continuously in an axial direction so as to span between the lower part of the outer peripheral surface of the fitting wall and the outer peripheral surface of the mounting wall below the annular shoulder surface to constitute the corresponding shape deformation portion, is arranged in each of two specific regions each having a width of 30 to 100 degrees in a circumferential direction about a circumferential center which is a site at an angular distance of 90 degrees on each of circumferentially opposite sides from a circumferential center of the hinge means. It is advantageous that the number and/or width of the flat surfaces arranged in one of the two specific regions be different from the number and/or width of the flat surfaces arranged in the other of the two specific regions. It is desirable that an additional flat surface extending radially inwardly from the upstream side edge of the flat surface, as viewed in the predetermined direction, be annexed to the upstream side edge of the flat surface.

Effects of the Invention

The container lid of the present invention does not pose a sanitary problem because of the contact of fingers with the closing wall of the inside plug. Instead, simply by rotating the lid body relative to the inside plug in a predetermined direction, the pass-through opening can be formed in the closing wall of the inside plug. In addition, the pass-through opening of the inside plug is formed by deforming the deformation region (without separating it from the closing wall), so that a so-called waste piece is not generated. In the closing wall of the inside plug, two or three of the breakable thin-walled lines are formed at equal intervals in the circumferential direction, two or three of the deformation regions are defined at equal intervals in the circumferential direction, the locked means is composed of the locked piece extending out upwardly from the upstream end of the deformation region, as viewed in the predetermined direction, and then extending radially inwardly, and each of the locking means is composed of the locking piece extending downwardly from the lower surface of the covering wall, and then extending in the predetermined direction. In such cases, the mutual engagement of the locked piece and the locking piece is sufficiently firm, and there is virtually no risk of the mutual engagement being impaired. The breakable line is broken fully reliably.

MODE FOR CARRYING OUT THE INVENTION

The present invention will now be described in further detail by reference to accompanying drawings illustrating preferred embodiments of a container lid configured according to the present invention.

A synthetic resin container lid configured according to the present invention is composed of an inside plug 2 shown in FIGS. 1 to 4 and a lid body 4 shown in FIGS. 5 to 8. The inside plug 2 can be injection molded from a suitable synthetic resin such as polyethylene or polypropylene. Similarly, the lid body 4 can also be injection molded from a suitable synthetic resin such as polyethylene or polypropylene.

Figure 1:
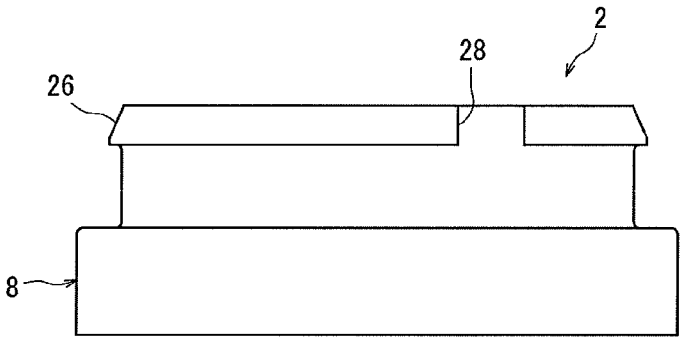
FIG. 1 is a front view of an inside plug in a preferred embodiment of a synthetic resin container lid configured according to the present invention.
Figure 2:
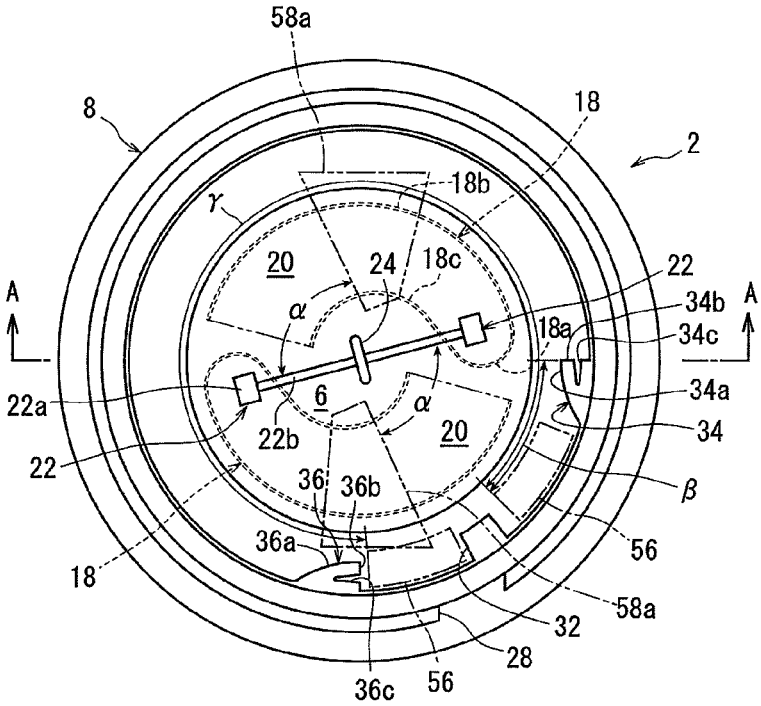
FIG. 2 is a plan view of the inside plug shown in FIG. 1.
Figure 3:
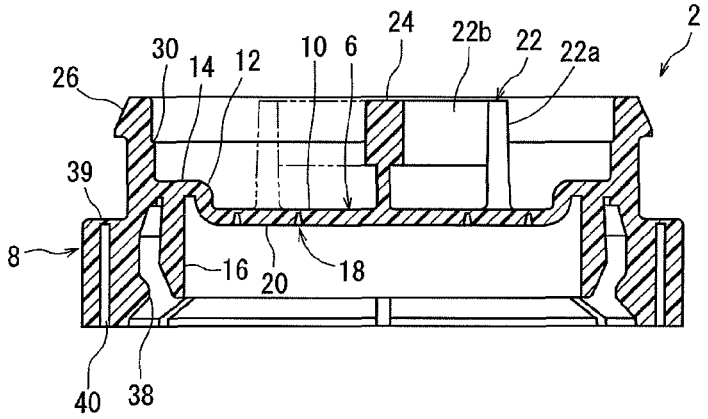
FIG. 3 is a sectional view, taken along line A-A in FIG. 2, of the inside plug shown in FIG. 1.
Figure 4:
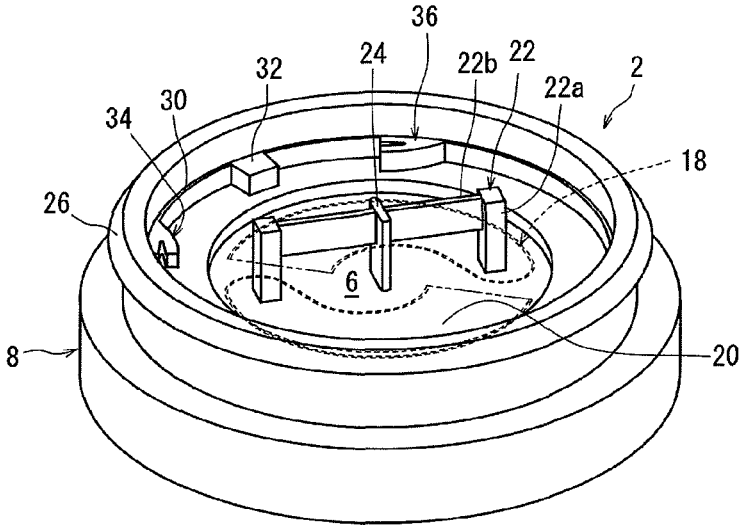
FIG. 4 is a perspective view of the inside plug shown in FIG. 1.

Descriptions will be offered with reference to FIGS. 1 to 3. The inside plug 2 includes a circular closing wall 6, and a mounting wall 8 of a nearly cylindrical shape connected to the outer peripheral edge of the closing wall 6. The closing wall 6 in the illustrated embodiment has a central main portion 10 extending substantially horizontally, an annular rising portion 12 rising nearly vertically and upwardly from the outer peripheral edge of the central main portion 10, and an annular outer peripheral edge portion 14 extending out substantially horizontally in a radially outward direction from the upper end of the annular rising portion 12. An annular sealing piece 16 suspending downwardly is annexed to the lower surface of the annular outer peripheral edge portion 14.

In the central main portion 10 of the closing wall 6, it is important that at least one breakable thin-walled line be formed, and preferably two or three of the breakable thin-walled lines be formed at equal intervals in the circumferential direction, whereby at least one deformation region, preferably two or three of the deformation regions, be defined. In the illustrated embodiment, two breakable thin-walled lines 18 are formed in point symmetry with respect to the center point of the closing wall 6, so that two deformation regions 20 are defined. Each of the breakable thin-walled lines 18 has a breakage start end portion 18*a* of a nearly semicircular shape, an outer arcuate portion 18*b* extending so as to be continuous with the radially outward end of the breakage start end portion 18*a*, and an inner arcuate portion 18*c* extending so as to be continuous with the radially inward end of the breakage start end portion 18*a*. The outer arcuate portion 18*b* extends at the outer peripheral edge portion of the central main portion 10 nearly arcuately. The inner arcuate portion 18*c* extends linearly from the radially inward end of the breakage start end portion 18*a*, then extends nearly arcuately in the central part of the central main portion 10, and assumes an arcuate shape as a whole. The downstream end of the outer arcuate portion 18*b* and the downstream end of the inner arcuate portion 18*c* are spaced from each other nearly radially. The deformation region 20 defined by the breakable thin-walled line 18 is allowed to extend arcuately counterclockwise in FIG. 2 (accordingly, as viewed from above).

It is important that a locked means 22 be disposed in each of the deformation regions 20. In the illustrated embodiment, each of the locked means 22 is composed of a locked piece extending out upwardly from the upstream end part of the deformation region 20, and then extending radially inwardly and, more specifically, is composed of the locked piece having a strut portion 22*a* extending out in a substantially vertically upward direction from the upper surface of an upstream end part of the deformation region 20, and an overhanging beam portion 22*b* extending substantially horizontally in a radially inward direction from an upper end part of the strut portion 22*a*. A common strut 24 extending out upwardly in a substantially vertical direction is disposed at the center of the upper surface of the closing wall 6, and the radially inward end of the overhanging beam portion 22*b* of each of the locked means 22 is connected to the common strut 24. Thus, the radially inward ends of the overhanging beam portions 22*b* of the respective locked means 22 are connected to each other via the common strut 24. If desired, the common strut 24 can be omitted, and the overhanging beam portions 22*b* extending out from the two strut portions 22*a* can be directly coupled to each other. However, it is preferred to dispose the common strut 24, from the viewpoint of, say, reliable transmission of force at the time of unsealing.

An annular locking ridge 26 overhanging radially outwardly is formed at the upper end part of the outer peripheral surface of the mounting wall 8. At a circumferentially predetermined site of the annular locking ridge 26, a positioning groove 28 is formed, as illustrated in FIGS. 1 and 2. An annular shoulder surface 30 facing upward is formed in an upper part of the inner peripheral surface of the mounting wall 8. In a region below the annular shoulder surface 30 in the inner peripheral surface of the mounting wall 8 and above the upper surface of the annular outer peripheral edge portion 14 of the closing wall 6, a single projection 32 of a nearly rectangular parallelepipedal shape, and ratchet pawls 34 and 36 arranged at positions spaced by a required distance on both sides of the projection 32 in the circumferential direction are formed, as will be clearly understood by reference to FIG. 4 along with FIG. 2. The ratchet pawls 34 and 36, respectively, have gently inclined surfaces 34*a* and 36*a* extending gradually radially inwardly and obliquely in a counterclockwise direction, and steep locking surfaces 34*b* and 36*b* located at counterclockwise downstream ends, in FIG. 2. Notches 34*c* and 36*c* extending clockwise are formed in the locking surfaces 34*b* and 36*b*.

A plurality of locking ridges 38 protruding radially inwardly are arranged in a lower end part of the inner peripheral surface of the mounting wall 8. Such locking ridges 38 are extended circumferentially with some spacing in the circumferential direction. If desired, it is possible to form an annular ridge extending continuously in the circumferential direction, instead of forming the plurality of locking ridges 38. The outer diameter of a lower half of the mounting wall 8 is larger than the outer diameter of its upper half, and an annular shoulder surface 39 extending substantially horizontally and facing upward is formed in an axially nearly middle site of the mounting wall 8. The wall thickness of the lower half of the mounting wall 8 is rendered larger than the wall thickness of its upper half and, in the mounting wall 8, there is formed an annular gap 40 having a depth ranging upward from the lower end of the mounting wall 8 up to the neighborhood of the upper end of an increased wall thickness part, accordingly up to the neighborhood of the annular shoulder surface 39, and extending in the circumferential direction. In relation to such an annular gap 40, one or several notches (not shown) extending from the annular gap 40 to the outer peripheral surface of the mounting wall 8 are formed in the lower half of the mounting wall 8. The annular gap 40 and the notches formed in relation to the annular gap 40 are of a well-known configuration by which the inside plug 2 mounted on the mouth neck of the container can be detached sufficiently easily from the mouth neck of the container for so-called sorted collection of garbage after the contents of the container are consumed, as will be described later (for the details of this configuration, reference to JP-A-Hei-10-59400 and JP-A-2004-83092 is requested).

Further referring to FIGS. 5 to 8, the lid body 4 in the illustrated embodiment has a body portion 42 and an outer lid 43. The body portion 42 includes a circular covering wall 44 extending substantially horizontally, and a cylindrical fitting wall 46 connected to the outer peripheral edge of the covering wall 44. It is important that at least one discharge opening 48, preferably two or three of the discharge openings 48 corresponding to the deformation regions 20 disposed in the inside plug 2, be formed in the central part of the covering wall 44. In the illustrated embodiment, two of the discharge openings 48 are formed in correspondence with the two deformation regions 20 disposed in the inside plug 2. The two discharge openings 48 located in point symmetry with respect to the center point of the covering wall 44 have shapes practically coinciding with the shapes of the deformation regions 20, and are arcuately extended counterclockwise in FIG. 5.

Figure 5:
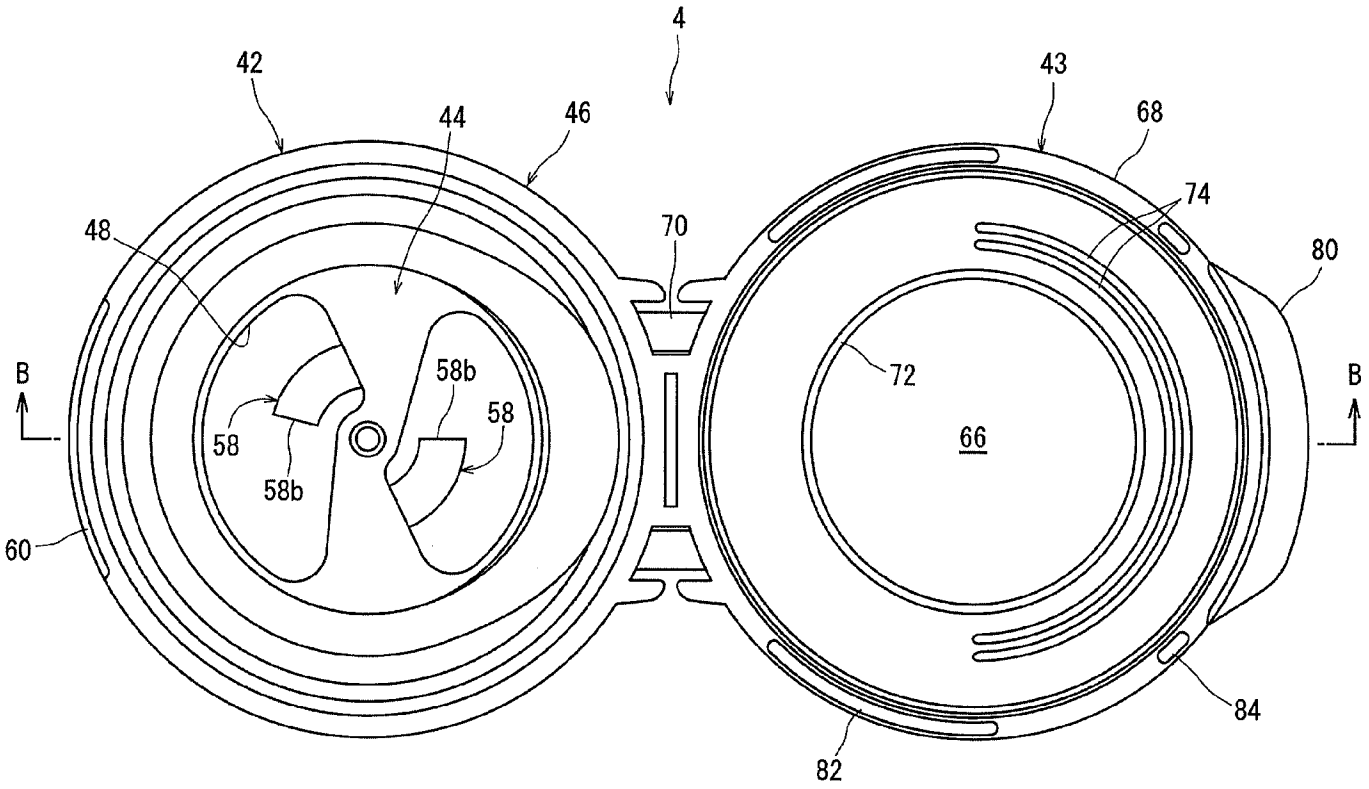
FIG. 5 is a plan view of a lid body in the preferred embodiment of the synthetic resin container lid configured according to the present invention.
Figure 6:
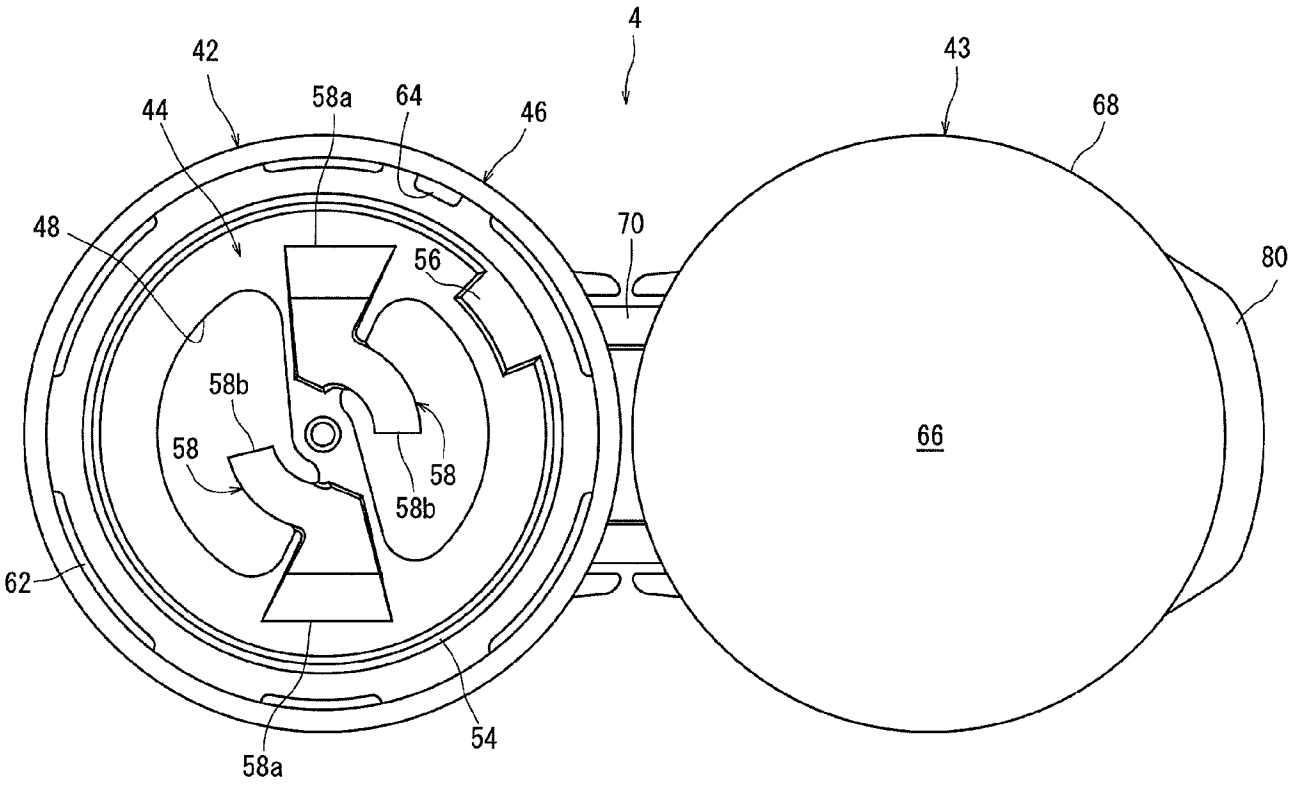
FIG. 6 is a bottom view of the lid body shown in FIG. 5.
Figure 7:
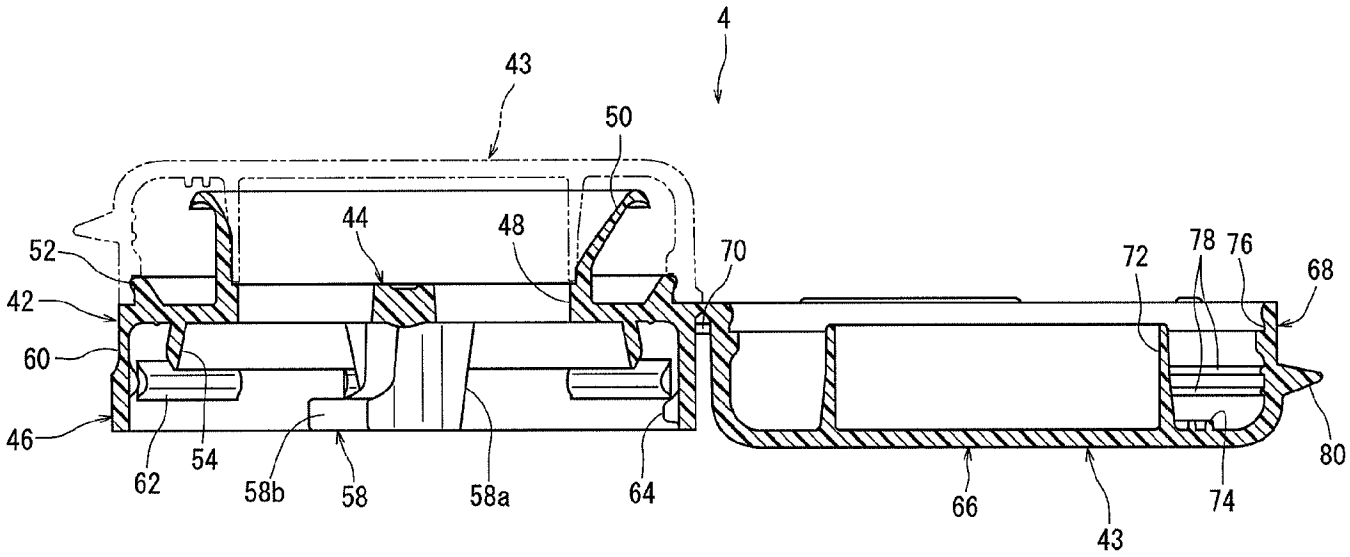
FIG. 7 is a sectional view, taken along line B-B in, FIG. 5, of the lid body shown in FIG. 5.
Figure 8:
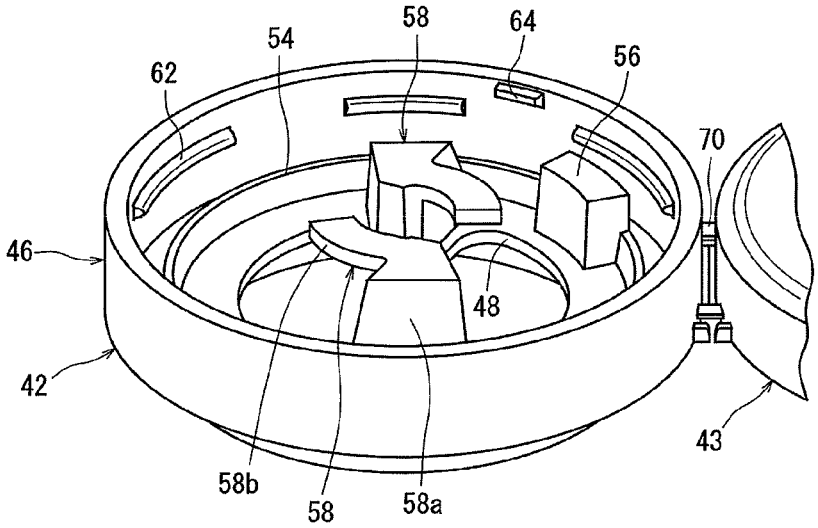
FIG.8 is a perspective view showing a part of the lid body shown in FIG. 5.

On the upper surface of the covering wall 44, a discharge guide wall 50 of a nearly cylindrical shape is formed which extends out upwardly on sides radially outward of the discharge openings 48. A site of the discharge guide wall 50 located on a right-hand side in FIGS. 5 and 7 is inclined somewhat rightward in an upward direction. The upper end part of the discharge guide wall 50 extends out radially outwardly in the upward direction and in a nearly semicircular shape in FIG. 7. On the upper surface of the covering wall 44, an annular locking ridge 52 is also formed which extends radially outwardly with some incline in an upward direction from the outer peripheral edge part of the upper surface. A sealing piece 54 of a cylindrical shape extending out downwardly is formed in an outer peripheral edge part of the lower surface of the covering wall 44. A locking projection 56 of a rectangular parallelepipedal shape protruding downwardly and radially inwardly is formed at a circumferentially predetermined position of the inner peripheral surface of the sealing piece 54 . As will be further mentioned later, the locking projection 56 collaborates with the aforementioned projection 32 and ratchet pawls 34, 36 disposed in the inside plug 2.

It is important that a locking means 58 be formed on the lower surface of the covering wall 44. In the illustrated embodiment, two of the locking means 58 are formed on the lower surface of the covering wall 44 in correspondence with the two locked means 22 formed in the inside plug 2. As will be clearly understood by reference to FIG. 8, each of the locking means 58 is composed of a locking piece extending downward from the lower surface of the covering wall 44 and then extending in a predetermined direction. More specifically, each locking means 58 is composed of the locking piece having a suspending pillar portion 58*a* suspending downwardly from between the discharge openings 48, and a protrusion 58*b* extending out arcuately counterclockwise in FIG. 5 from the lower end of the suspending pillar portion 58*a*. Each of the two suspending pillar portions 58*a* located in diametrically opposite positions has a cross-sectional shape which is nearly trapezoidal. In FIG. 5 as a plan view, it is advantageous from the aspect of shaping in a mold that substantially all of each protrusion 58*b* is located in the discharge opening 48.

The fitting wall 46, which may be in a substantially cylindrical shape, is suspended from the outer peripheral edge of the covering wall 44. A plurality of engaging ridges 62 extending in the circumferential direction at circumferential intervals are formed on the inner peripheral surface of the fitting wall 46. Further, a positioning projection 64 in the shape of a nearly rectangular parallelepiped is formed at a predetermined circumferential position in a lower end part of the inner peripheral surface of the fitting wall 46. As will be further mentioned later, the positioning projection 64 collaborates with the aforementioned positioning groove 28 formed in the inside plug 2. If desired, a positioning projection can be formed at a suitable site of the inside plug 2, while a positioning groove collaborating with this positioning projection can be formed at a suitable site of the lid body 4. A depression 60 extending arcuately is formed at a specific angular position in an upper part of the outer peripheral surface of the fitting wall 46.

With further reference to FIGS. 5 to 8, the outer lid 43 is composed of a circular top panel wall 66, and a cylindrical skirt wall 68 suspending from the peripheral edge of the top panel wall 66. Such an outer lid 43 is pivotably coupled to the body portion 42 by coupling a specified circumferential site of the lower end of the skirt wall 68 to a specified circumferential site of the fitting wall of the body portion 42 via a hinge means 70. The lid body 4 composed of the body portion 42 and the outer lid 43 is molded in a state illustrated by solid lines in FIGS. 5 to 7, and the outer lid 43 is pivotable relative to the body portion 42 between an open position illustrated by the solid lines in FIGS. 5 to 7 and a closed position indicated by dashed double-dotted lines in FIG. 7. The hinge means 70, which may be of a well-known shape per se, is located on a side diametrically opposite to the above depression 60 formed in the fitting wall 46 of the body portion 42. A sealing piece 72 of a cylindrical shape is formed on the inner surface of the top panel wall 66. On the inner surface of the top panel wall 66, a two-striped convexity 74 is also formed which extends in a semicircular shape radially outwardly of the sealing piece 72 in a right half of the top panel wall 66 in FIGS. 5 to 7. An annular locking groove 76 is formed in a lower part of the inner peripheral surface of the skirt wall 68. On the inner peripheral surface of the skirt wall 68, a two-striped convexity 78 is also formed which extends semiarcuately in an axially intermediate part of the right half in FIG. 7. An arcuate flange 80 located on a side diametrically opposite to the hinge means 70 is formed on the outer peripheral surface of the skirt wall 68. Further, two relatively long arcuate ridges 82 and two relatively short arcuate ridges 84 are formed on the leading end surface, i.e., lower end surface, of the skirt wall 68. When the outer lid 43 is brought to the closed position indicated by the dashed double-dotted lines in FIG. 7, the outer peripheral surface of the sealing piece 72 is brought into intimate contact with the inner peripheral surface of the discharge guide wall 50 in the body portion 42. Moreover, the annular locking groove 76 is locked to the annular locking ridge 52 of the body portion 42, so that the outer lid 43 is releasably locked at the closed position. The arcuate ridges 82 and 84 are brought into intimate contact with the peripheral edge part of the upper surface of the covering wall 44 of the body portion 42.

Figure 9:
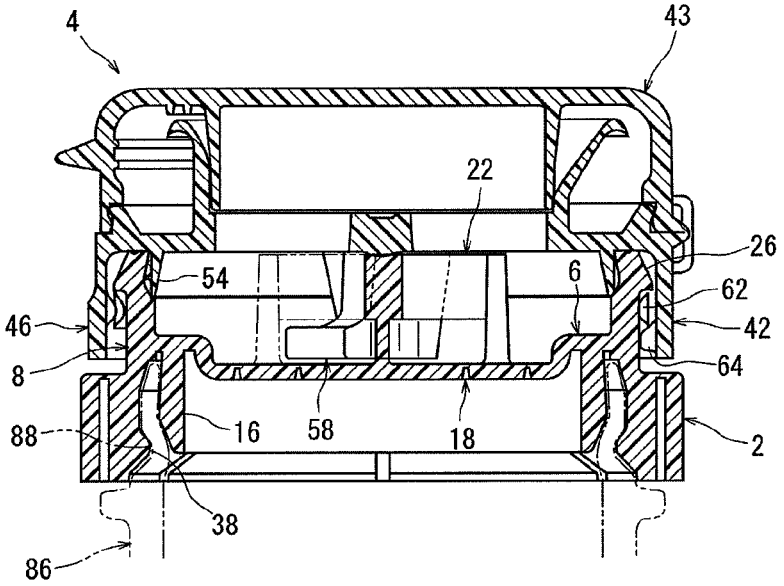
FIG. 9 is a sectional view showing a state where the lid body illustrated in FIGS. 5 to 8 is mounted, as required, on the inside plug illustrated in FIGS. 1 to 4.

The inside plug 2 and lid body 4 as described above are combined as illustrated in FIG. 9. In detail, the body portion 42 in the lid body 4 having the outer lid 43 in the closed position is forcibly caused to descend with respect to the inside plug 2, thereby fitting the fitting wall 46 of the body portion 42 onto the outer peripheral surface of the mounting wall 8 of the inside plug 2. On this occasion, the positioning projection 64 is advanced into the positioning groove 28, with the circumferential position of the positioning projection 64 (FIG. 6) formed in the lower end part of the inner peripheral surface of the fitting wall 46 being aligned with the circumferential position of the positioning groove 28 (FIG. 1) formed in the upper end part of the outer peripheral surface of the mounting wall 8, whereby the relative angular position of the lid body 4 with respect to the inside plug 2 is regulated. When the lid body 4 is lowered relative to the inside plug 2 so as to enter the state as shown in FIG. 9, the engaging ridge 62 formed on the inner peripheral surface of the fitting wall 46 is locked to the locking ridge 26 formed on the outer peripheral surface of the mounting wall 8, so that the lid body 4 is rotatably mounted on the inside plug 2. The sealing piece 54 of the lid body 4 is intimately contacted with the upper end part of the inner peripheral surface of the mounting wall 8 of the inside plug 2. The fitting wall 46 of the lid body 4 is fitted to a part of the mounting wall 8 of the inside plug 2 above the annular shoulder surface 39, and the lower end of the fitting wall 46 is located slightly above the annular shoulder surface 39. It is advantageous that the outer peripheral surface of the fitting wall 46 be substantially flush with the outer peripheral surface of the mounting wall 8 below the annular shoulder surface 39 (difference between the outer diameters of both outer peripheral surfaces is 1 mm or less). As indicated by the dashed double-dotted lines in FIG. 2, with the lid body 4 being mounted on the inside plug 2 as required, the locking projection 56 formed in the sealing piece 54 of the lid body 4 is located adjacent to and counterclockwise downstream, in FIG. 2, of the projection 32 formed on the inner peripheral surface of the mounting wall 8 of the inside plug 2. The projection 32 and the locking projection 56 collaborate to constitute a rotation inhibiting means, inhibiting the lid body 4 from rotating relative to the inside plug 2 clockwise in FIG. 2 (clockwise as viewed from above in FIG. 9) . Each of the protrusions 58*b* of the locking means 58 in the lid body 4 are located below the respective overhanging beam portions 22*b* of the locked means 22 in the inside plug 2, and somewhat apart therefrom toward the upstream side in the counterclockwise direction in FIG. 2 (in the illustrated embodiment, the pair of overhanging beam portions 22*b* are not in complete point symmetry, but are slightly displaced from each other, and accordingly, the pair of protrusions 58*b* are not in complete point symmetry, but are slightly displaced from each other.)

In FIG. 9, a mouth neck 86 of a container, to which the container lid configured in accordance with the present invention is applied, is also shown by dashed double-dotted lines. The mouth neck 86 of the container, which can be formed from a suitable synthetic resin or glass, is in a cylindrical shape as a whole, and has an annular locking groove 88 formed in the outer peripheral surface thereof. As clearly illustrated in FIG. 9, the mouth neck 86 of the container is received between the lower half of the inner peripheral surface of the mounting wall 8 and the outer peripheral surface of the sealing piece 16 of the inside plug 2, whereby the container lid is mounted on the mouth neck 86 of the container. The locking ridge 38 formed in the lower end part of the inner peripheral surface of the mounting wall 8 of the inside plug 2 is locked to the locking groove 88 of the mouth neck 86, and the sealing piece 16 of the inside plug 2 is intimately contacted with the inner peripheral surface of the mouth neck 86

In consuming contents, such as a seasoning liquid, accommodated in the container, the lid body 4 is rotated relative to the inside plug 2 counterclockwise as viewed from above in FIG. 9 (counterclockwise in FIG. 2). When the lid body 4 is rotated relative to the inside plug 2 by a predetermined angle $\alpha$ (FIG. 2), each of the two locking means 58 disposed in the lid body 4 is locked to each of the two locked means 22 disposed in the inside plug 2. In more detail, the protrusion 58*b* of the locking means 58 is advanced into an area below the overhanging beam portion 22*b* of the locked means 22, and the suspending pillar portion 58*a* of the locking means 58 is contacted with the overhanging beam portion 22*b* of the locked means 22. The predetermined angle $\alpha$ is advantageously of the order of 50 to 60 degrees. When the lid body 4 is further rotated relative to the inside plug 2 by an angle exceeding the predetermined angle $\alpha$, stress is applied to each of the breakable thin-walled lines 18 via the locked means 22, and each breakable thin-walled line 18 begins to be broken, starting at the breakage start end portion 18*a*.

In the illustrated embodiment, when the lid body 4 is rotated relative to the inside plug 2 by an angle $\beta$, which is smaller than the predetermined angle $\alpha$ by a value of the order of 0 to 20 degrees (0 degrees$\leq\alpha-\beta\leq$20 degrees), as indicated by dashed double-dotted lines in FIG. 2, the locking projection 56 disposed in the lid body 4 elastically climbs over the ratchet pawl 34 disposed in the inside plug 2, and the rotation of the lid body 4 relative to the inside plug 2 in a clockwise direction as viewed from above in FIG. 9 (in a clockwise direction in FIG. 2) is inhibited by the collaboration between the locking projection 56 and the steep locking surface 34*b* of the ratchet pawl 34. Thus, the locking projection 56 and the ratchet pawl 34 collaborate to constitute a return rotation inhibiting means.

Figure 10:
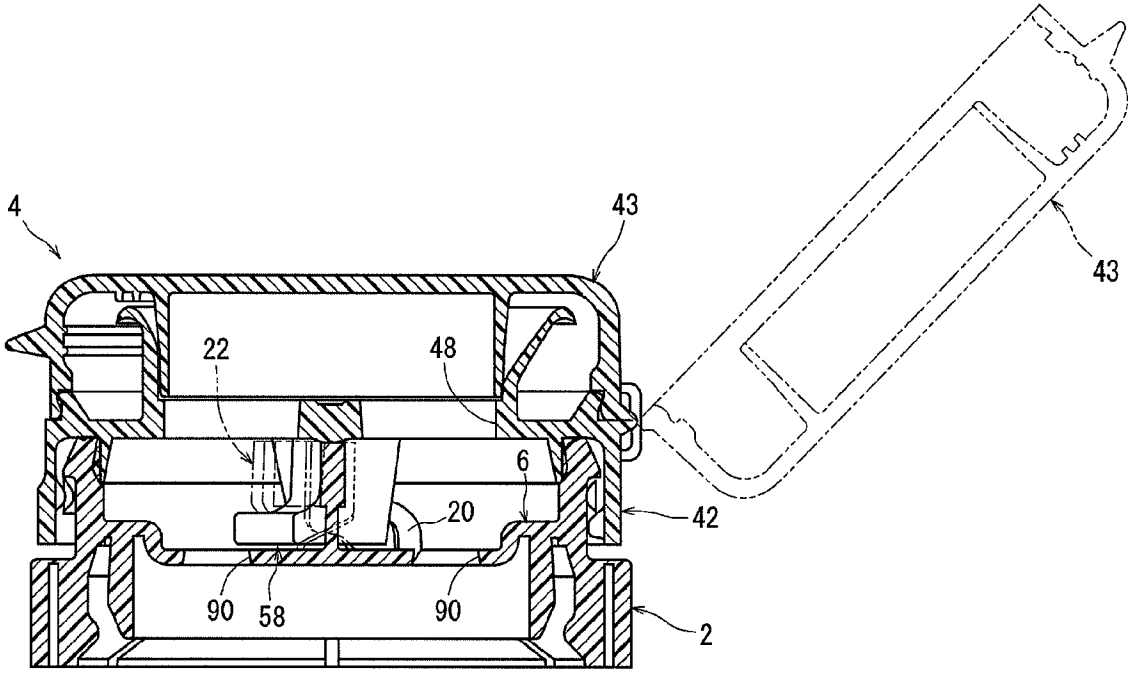
FIG. 10 is a sectional view showing a state where the lid body is rotated relative to the inside plug by a predetermined angle counterclockwise, as viewed from above, starting from the state illustrated in FIG. 9, to break a breakable thin-walled line of the inside plug, thereby deforming a deformation region, whereby a pass-through opening is formed.

As the rotation of the lid body 4 beyond the predetermined angle $\alpha$ proceeds, the breakage of the breakable thin-walled line 18 progresses from the breakage start end portion 18*a* to the outer arcuate portion 18*b* and the inner arcuate portion 18*c*. When the rotation of the lid body 4 relative to the inside plug 2 proceeds to reach an angle $\gamma$ (FIG. 2), the locking projection 56 disposed in the lid body 4 contacts the projection 32 disposed in the inside plug 2, as indicated by dashed double-dotted lines in FIG. 2, whereby a further counterclockwise rotation of the lid body 4 relative to the inside plug 2 is inhibited. Thus, the locking projection 56 and the projection 32 collaborate to constitute a rotation restricting means for restricting the rotation of the lid body 4 to the angle $\gamma$. The angle $\gamma$ is advantageously of the order of 300 to 320 degrees. When the lid body 4 is rotated relative to the inside plug 2 by the angle $\gamma$, each of the breakable thin-walled lines 18 is broken up to substantially the downstream ends of the outer arcuate portion 18*b* and the inner arcuate portion 18*c*. With the progress of the breakage of the breakable thin-walled line 18, the deformation region 20 disposed in the closing wall 6 of the inside plug 2 is deformed upward and counterclockwise downstream into the form of a roll, as illustrated in FIG. 10, with the result that two pass-through openings 90 (FIG. 10) are produced in the closing wall 6. The downstream end of the outer arcuate portion 18*b* and the downstream end of the inner arcuate portion 18*c* of the breakable thin-walled line 18 are spaced from each other, and the area between the downstream ends is not broken. Nor is the deformation region 20 separated from the closing wall 6.

In the illustrated embodiment, when the lid body 4 is rotated relative to the inside plug 2 by the angle of up to $\gamma$, the locking projection 56 disposed in the lid body 4 elastically climbs over the ratchet pawl 36 disposed in the inside plug 2. Thus, the clockwise rotation of the lid body 4 relative to the inside plug 2 is inhibited by collaboration between the locking projection 56 and the steep locking surface 36*b* of the ratchet pawl 36. Hence, the locking projection 56 and the ratchet pawl 36 collaborate to constitute a reverse rotation inhibiting means .

After the pass-through openings 90 are formed in the closing wall 6 of the inside plug 2 in the above-described manner, the outer lid 43 of the lid body 4 is pivoted to a position indicated by dashed double-dotted lines in FIG. 10, and then the container is tilted. As a result, the contents of the container are flowed out through the pass-through openings 90 formed in the closing wall 6 of the inside plug 2 and the discharge openings 48 disposed in the lid body 4, and discharged while being guided by the discharge guide wall 50 of the lid body 4.

Figure 11:
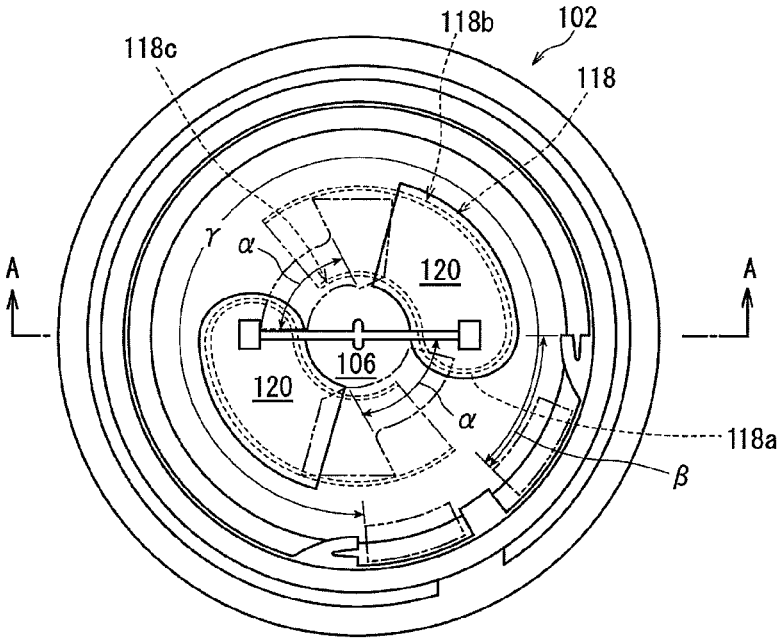
[FIG. 11] is a plan view showing a modification of the inside plug in the synthetic resin container lid configured according to the present invention.
Figure 12:
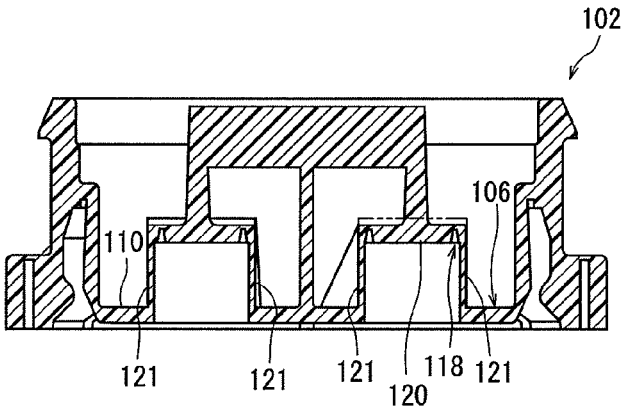
FIG. 12 is a sectional view, taken along line A-A in FIG. 11, of the inside plug shown in FIG. 11.
Figure 13:
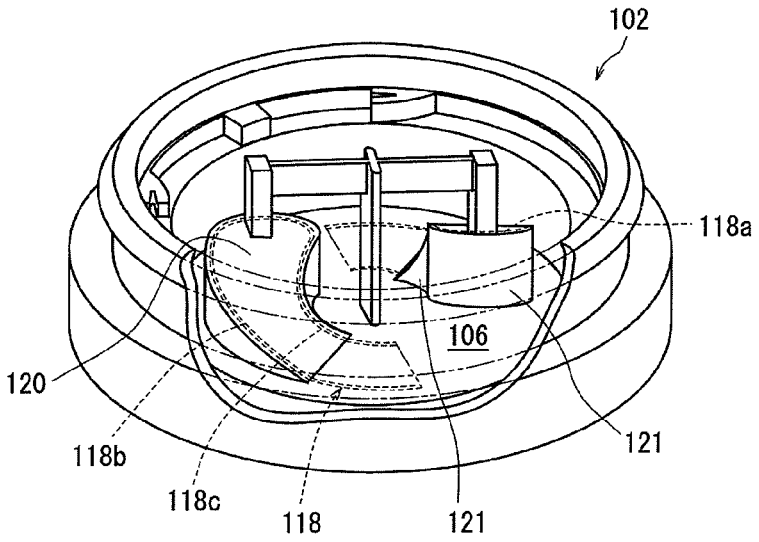
FIG. 13 is a perspective view of the inside plug shown in FIG. 11.

FIGS. 11 to 13 illustrate a modification of the inside plug. In an inside plug 102 shown in FIGS. 11 to 13, as will be clearly understood by reference to FIG. 13, in particular, each of deformation regions 120 extends horizontally from the downstream end toward an upstream side along a horizontally extending site of a central main portion 110 of a closing wall 106, and then extends gradually upwardly obliquely in an upstream direction up to the upstream end. A breakable thin-walled line 118 defining each of the deformation regions 120 has a breakage start end portion 118*a* of a semicircular shape, and also has an outer arcuate portion 118*b* extending so as to be continuous with the radially outward end of the breakage start end portion 118*a,* and an inner arcuate portion 118*c* extending so as to be continuous with the radially inward end of the breakage start end portion 118*a*. The outer arcuate portion 118*b* extends nearly arcuately, while the inner arcuate portion 118*c* extends linearly from the radially inward end of the breakage start end portion 118*a,* then extends nearly arcuately in the central part of the central main portion 110, and assumes an arcuate shape as a whole. The downstream end of the outer arcuate portion 118*c* and the downstream end of the inner arcuate portion 118*c* are spaced from each other nearly radially. Since an upstream part of the deformation region 120 extends gradually upwardly obliquely in the upstream direction up to the upstream end, a rising surface 121 extending vertically is formed in the central main portion 110 of the closing wall 106 adjacently to the breakage start end portion 118*a* and upstream parts of the outer arcuate portion 118*b* and the inner arcuate portion 118*c* of each of the breakable thin-walled lines 118. In the illustrated embodiment, the upstream part of the deformation region 120 is inclined upward toward the upstream side up to the upstream end, but if desired, substantially the whole of the deformation region 120 can be inclined upward toward the upstream side. The features, other than the above-mentioned features, of the inside plug 102 shown in FIGS. 11 to 13 are substantially the same as those of the inside plug 2 shown in FIGS. 1 to 4.

Figure 14:
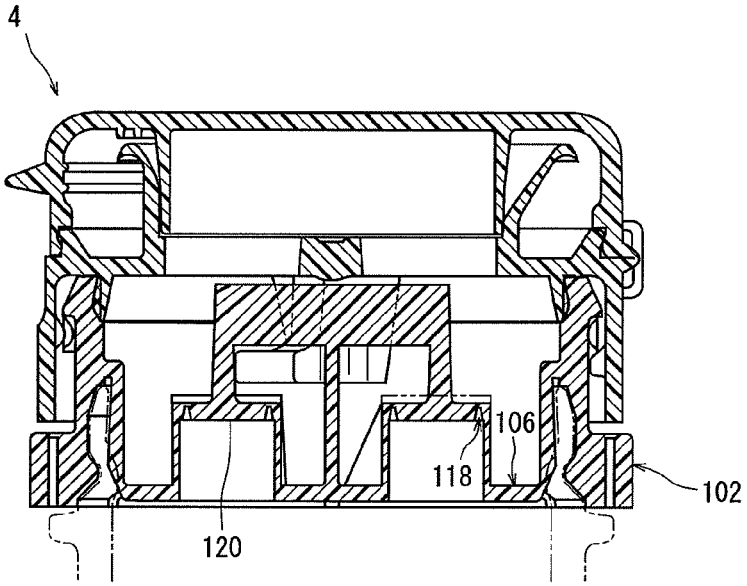
FIG. 14 is a sectional view showing a state where the lid body illustrated in FIGS. 5 to 8 is mounted, as required, on the inside plug illustrated in FIGS. 11 to 13.
Figure 15:
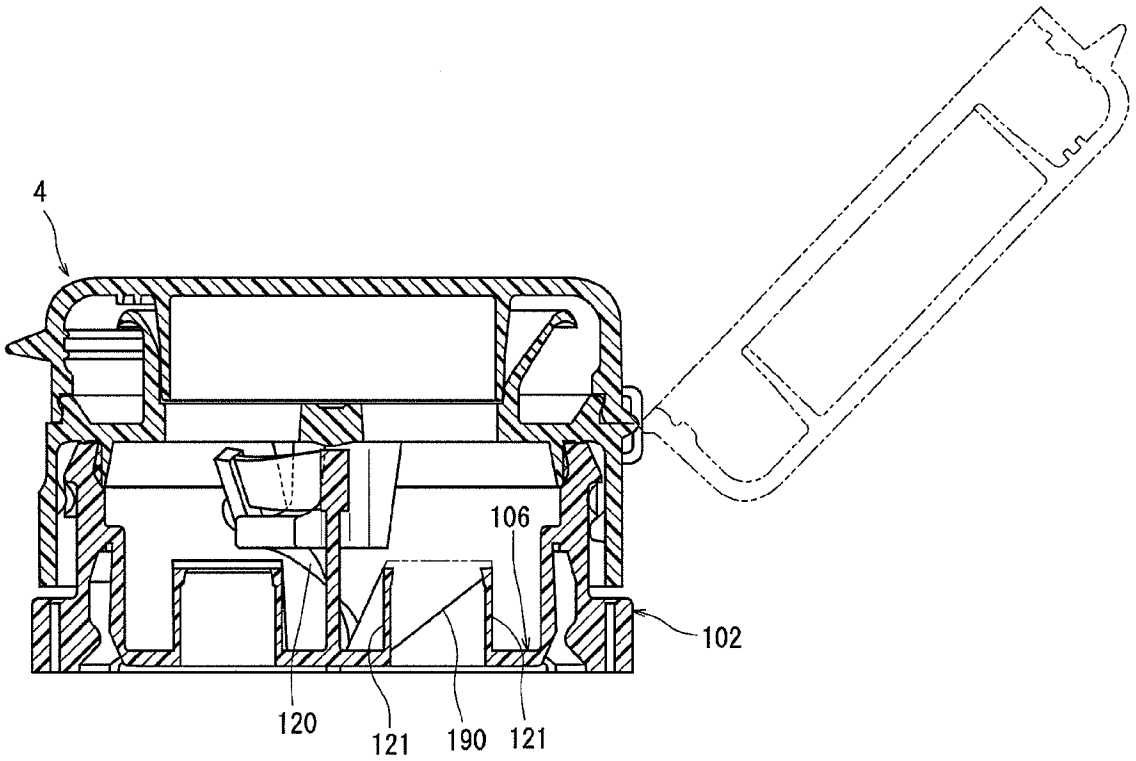
FIG. 15 is a sectional view showing a state where the lid body is rotated relative to the inside plug by a predetermined angle counterclockwise, as viewed from above, starting from the state illustrated in FIG. 14, to break a breakable thin-walled line of the inside plug, thereby deforming a deformation region, whereby a pass-through opening is formed.

FIG. 14 shows a state where the lid body 4 illustrated in FIGS. 5 to 8 is combined with the inside plug 102 illustrated in FIGS. 11 to 13. The manner of a combination of the inside plug 102 illustrated in FIGS. 11 to 13 and the lid body 4 illustrated in FIGS. 5 to 8 is substantially the same as the aforementioned manner of combination of the inside plug 2 illustrated in FIGS. 1 to 4 and the lid body 4 illustrated in FIGS. 5 to 8. In consuming contents, such as a seasoning, accommodated in the container, the lid body 4 is rotated relative to the inside plug 102 counterclockwise as viewed from above in FIG. 14, as explained mainly by reference to FIGS. 2, 9 and 10. In accordance with this rotation, the breakable thin-walled line 118 is broken, whereupon the deformation region 120 is deformed to generate a pass-through opening 190. In the inside plug 102 shown in FIGS. 11 to 13, the upstream end part of each of the deformation regions 102 extends gradually upwardly obliquely in an upstream direction. Thus, each of the deformation regions 102 is deformed upward and counterclockwise downstream into a rolled form with the progress of the breakage of the breakable thin-walled line 118, whereby two of the pass-through openings 190 (FIG. 15) are produced in the closing wall 6. Since the upstream part of the deformation region 120 is inclined upwardly toward the upstream side, the opening area of the resulting pass-through opening 190 is larger than when the whole of the deformation region 120 is extended horizontally. Behaviors, other than the above-mentioned behaviors, of the inside plug 102 and the lid body 4 during the formation of the pass-through opening 190 are substantially the same as those by the combination of the inside plug 2 and the lid body 4.

FIGS. 16 to 22 show another preferred embodiment of a container lid configured in accordance with the present invention. Such a container lid is composed of an inside plug 202 illustrated in FIGS. 16 to 18, and a lid body 204 illustrated in FIGS. 19 and 20.

Figure 16:
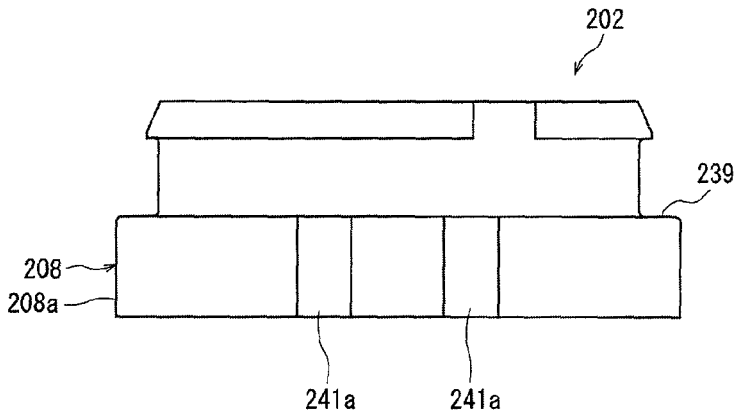
FIG. 16 is a front view of an inside plug in another preferred embodiment of a synthetic resin container lid configured according to the present invention.
Figure 17:
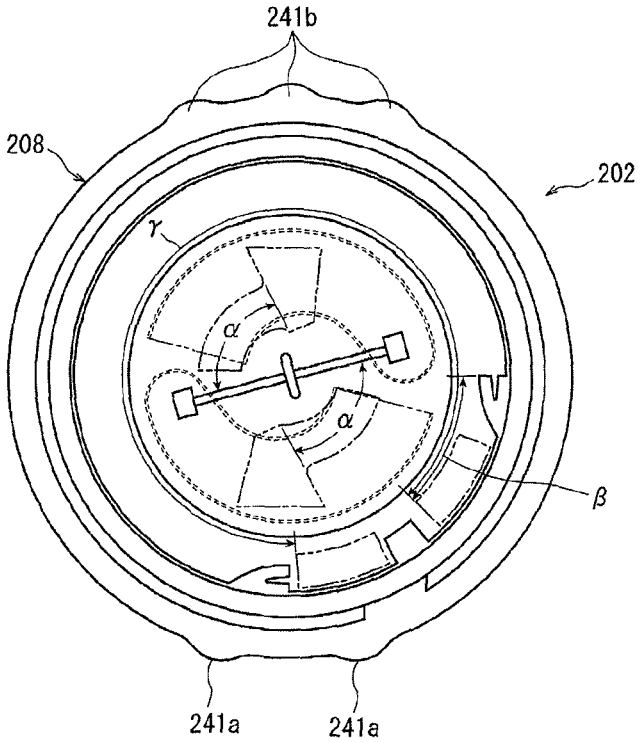
FIG. 17 is a plan view of the inside plug shown in FIG. 16.
Figure 18:
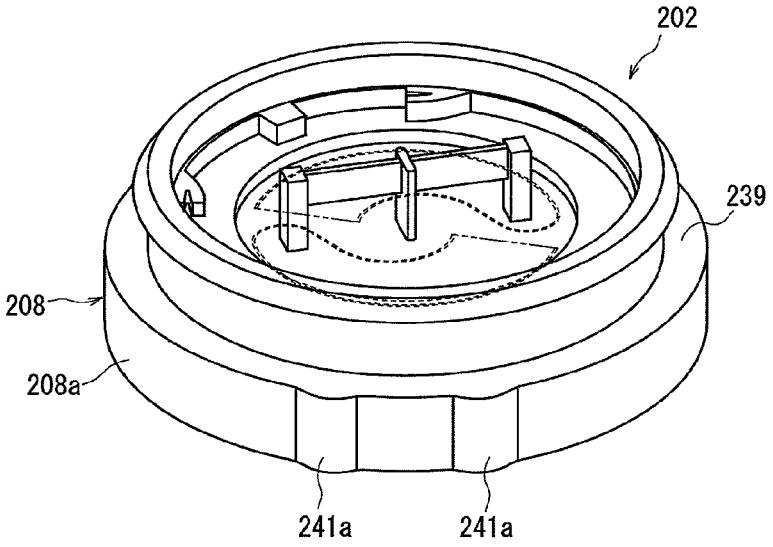
FIG. 18 is a perspective view of the inside plug shown in FIG. 16.

By reference to FIGS. 16 to 18, the inside plug 202 is configured such that on the outer peripheral surface 208*a* of a mounting wall 208 below its annular shoulder surface 239, two ridges 241*a* extending continuously from the lower end to the upper end are formed at an interval in the circumferential direction at an angular site located in a lower part in FIG. 17, and three ridges 241*b* extending continuously from the lower end to the upper end are formed at equal intervals in the circumferential direction at an angular site located in an upper part in FIG. 17 (the positional relationship between the ridges 241*a* and 241*b* will be further mentioned later). The constitutions, other than the above-mentioned constitutions, of the inside plug 202 are substantially the same as those of the inside plug 2 shown in FIGS. 1 to 4.

Figure 19:
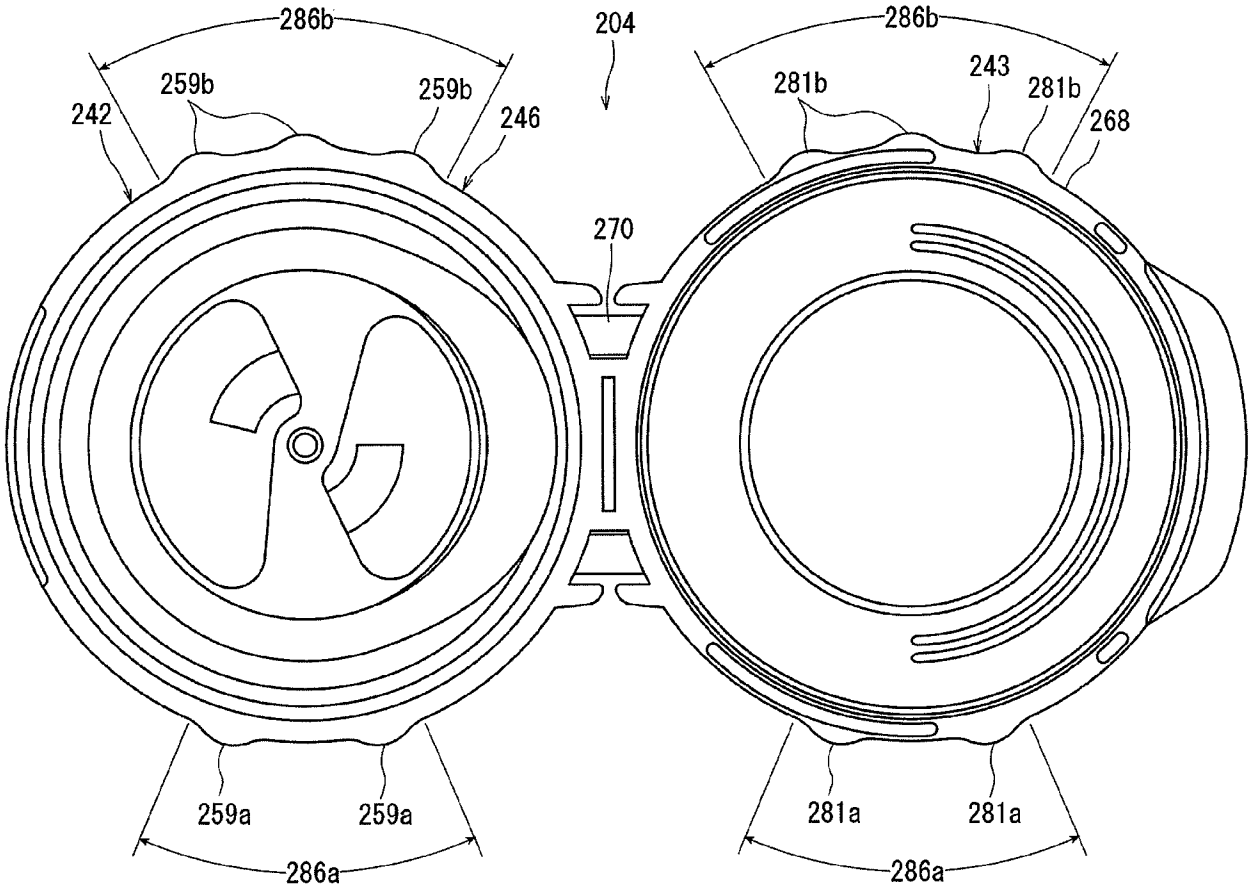
FIG. 19 is a plan view of a lid body in the other preferred embodiment of the synthetic resin container lid configured according to the present invention.
Figure 20:
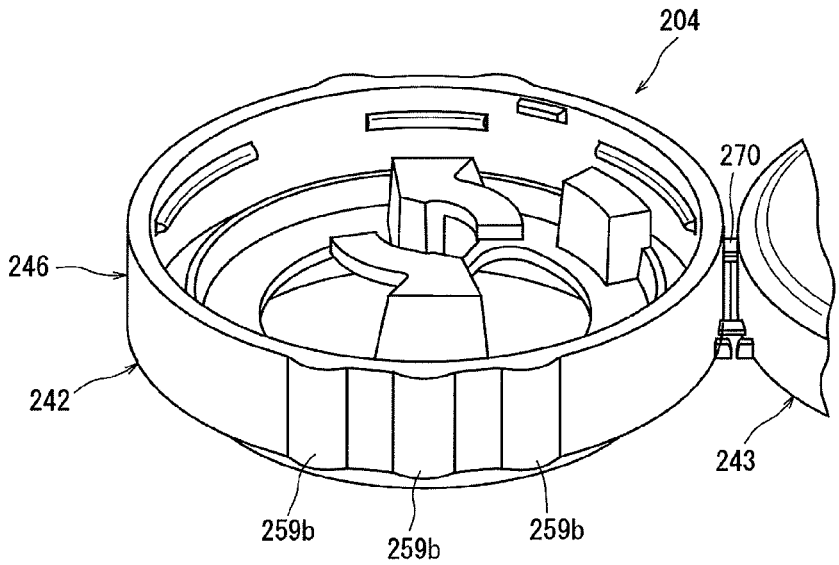
FIG. 20 is a perspective view showing a part of the lid body shown in FIG. 16.
Figure 21:
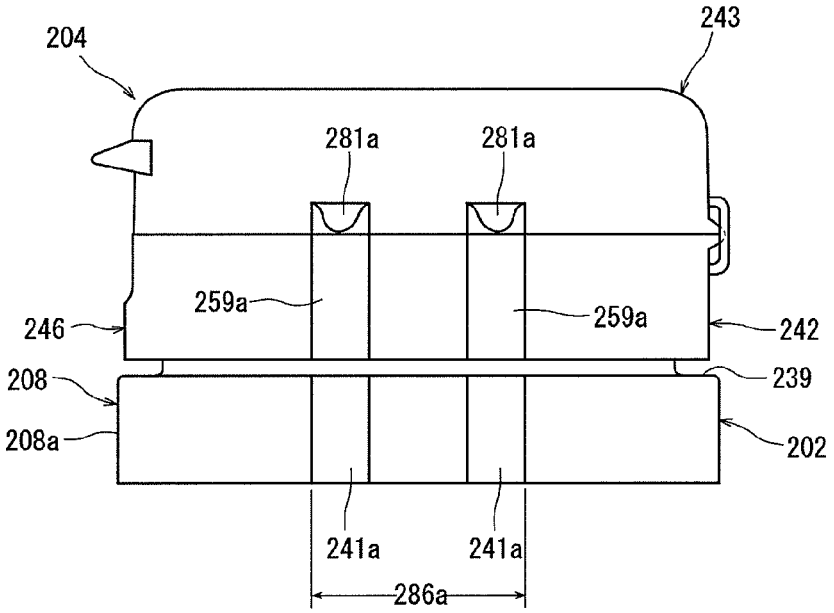
FIG. 21 is a front view showing a state where the lid body illustrated in FIGS. 19 and 20 is mounted, as required, on the inside plug illustrated in FIGS. 16 to 18.

As will be understood by reference to FIGS. 19 and 20, on the other hand, the lid body 204 is configured such that on the outer peripheral surface of a fitting wall 246 of a body portion 242, two ridges 259*a* extending continuously from the upper end to the lower end are formed at an interval in the circumferential direction at an angular site located in an lower part in FIG. 19, and three ridges 259*b* extending continuously from the upper end to the lower end are formed at equal intervals in the circumferential direction at an angular site located in a upper part in FIG. 19 (as will be described in further detail later, the ridge 259*a* corresponds to the ridge 241*a,* and the ridge 259*b* corresponds to the ridge 241*b*). In a lower end part of the outer peripheral surface of a skirt wall 268 of an outer lid 243, two ridges 281*a* are formed at an interval in the circumferential direction at a site located below in FIG. 19, while three ridges 281*b* are formed at equal intervals in the circumferential direction at an angular site located above in FIG. 19. The upper end of each of the ridges 281*a* and 281*b* is inclined radially inwardly in an upward direction. As will be understood by reference to FIG. 21, when the outer lid 43 is brought to a closed position with respect to the body portion 242 of the lid body 204, the ridges 281*a* and 281*b* are aligned with the above-mentioned ridges 259*a* and 259*b* formed on the outer peripheral surface of the fitting wall 246 of the body portion 242. The constitutions, other than the above-mentioned constitutions, of the lid body 4 are substantially the same as those of the lid body 4 shown in FIGS. 5 to 8.

The inside plug 202 and lid body 204 mentioned above are combined in a state as shown in FIG. 21 in substantially the same manner as the manner of combination of the inside plug 2 illustrated in FIGS. 1 to 4 and the lid body 4 illustrated in FIGS. 5 to 8. When the inside plug 202 and the lid body 204 are combined as required, as will be clearly understood by reference to FIG. 21 along with FIG. 19, the ridge 241*a* formed on the outer peripheral surface of the mounting wall 208 and the ridge 259*a* formed on the outer peripheral surface of the fitting wall 246 are located in a specific region 286*a* having a width of nearly 30 to 90 degrees in the circumferential direction about a circumferential center which is a site at a 90-degree angular distance in a clockwise direction from the circumferential center of a hinge means 270 of the lid body 204 as viewed from above, and two of the ridges 241*a* and two of the ridges 259*a* extend substantially continuously in the axial direction so as to span between the outer peripheral surface of the fitting wall 246 and the outer peripheral surface 208*a* of the mounting wall 208 below an annular shoulder surface 239 of the mounting wall 208. Moreover, the ridge 241*b* formed on the outer peripheral surface of the mounting wall 208 and the ridge 259*b* formed on the outer peripheral surface of the fitting wall 246 are located in a specific region 286*b* having a width of nearly 30 to 90 degrees in the circumferential direction about a circumferential center which is a site at a 90-degree angular distance in a counterclockwise direction from the circumferential center of the hinge means 270 as viewed from above, and three of the ridges 241*b* and three of the ridges 259*b* extend continuously in the axial direction so as to span between the outer peripheral surface of the fitting wall 246 and the outer peripheral surface 208*a* below the annular shoulder surface 239 of the mounting wall 208.

Figure 22:
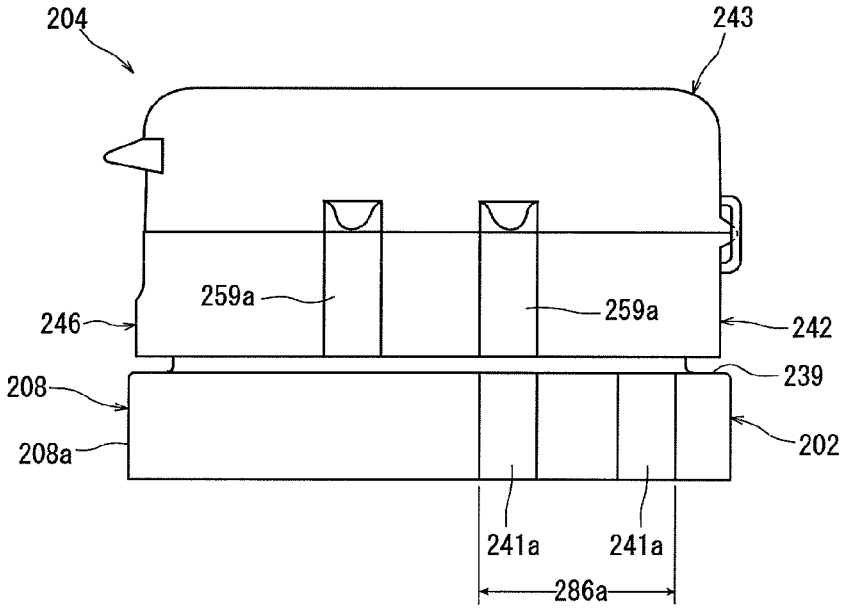
FIG. 22 is a front view showing a state where the lid body is rotated relative to the inside plug by a predetermined angle counterclockwise, as viewed from above, starting from the state illustrated in FIG. 21.

The relative relationship of the corresponding shape deformation portions (i.e., ridge 241*a* vs. ridge 259*a*, and ridge 241*b* vs. ridge 259*b*), with the lid body 204 being mounted as required on the inside plug 202, is changed when the lid body 204 is rotated relative to the inside plug 202. It is important here for this change to indicate explicitly that the lid body 204 has been rotated relative to the inside plug 202. According to the illustrated embodiment, in the state shown in FIG. 21, the ridge 241*a* and the ridge 259*a* in the specific region 286*a*, and the ridge 241*b* and the ridge 259*b* in the specific region 286*b*, extend continuously in the axial direction so as to span between the outer peripheral surface of the fitting wall 246 and the outer peripheral surface 208*a* of the mounting wall 208 below the annular shoulder surface 239. When the lid body 204 is rotated relative to the inside plug 202 by the angle γ, the ridge 259*a* is displaced somewhat clockwise relative to the ridge 241*a* in the specific region 286*a* as viewed from above, and the ridge 259*b* is displaced somewhat clockwise relative to the ridge 241*b* in the specific region 286*b* as viewed from above, as illustrated in FIG. 22. Thus, it is explicitly shown that the lid body 204 has been rotated relative to the inside plug 202 (this ensures so-called tamper-evident properties).

Figure 23:
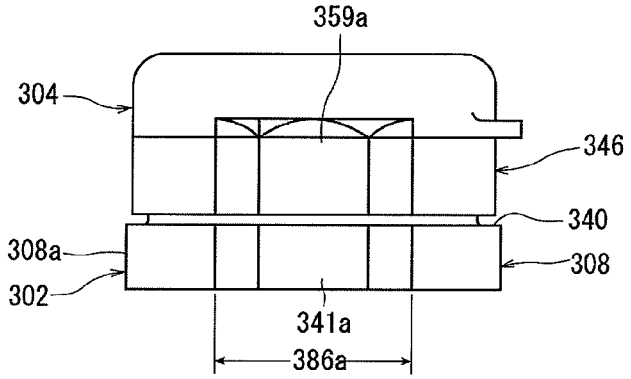
FIG. 23 is a front view of a state where the lid body is mounted, as required, on the inside plug, showing a modification of a shape deformation portion.
Figure 24:
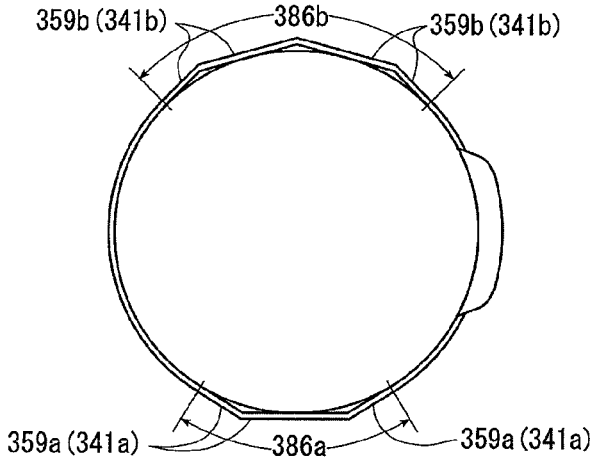
FIG. 24 is a plan view of the inside plug and the lid body shown in FIG. 23.

FIGS. 23 and 24 show a modification of the shape deformation portion. In the modification shown in FIGS. 23 and 24, three flat surfaces 341*a* extending in the axial direction are formed on the outer peripheral surface 308*a* of a mounting wall 308 below an annular shoulder surface 339 in a specific region 386*a*, and three flat surfaces 359*a* extending in the axial direction are formed on the outer peripheral surface of a fitting wall 346 in the specific region 386*a*. In a specific region 386*b*, four flat surfaces 341*b* extending in the axial direction are formed on the outer peripheral surface 308*a* of the mounting wall 308 below the annular shoulder surface 339, and four flat surfaces 359*b* extending in the axial direction are formed on the outer peripheral surface of the fitting wall 346. The flat surfaces 341*a* and 359*a* arranged in the specific region 386*a*, and the flat surfaces 341*b* and 359*b* arranged in the specific region 386*b* are rendered different in number and width. When the inside plug 302 and the lid body 304 are combined as required, the flat surfaces 341*a* and 359*a* in the specific region 386*a*, and the flat surfaces 341*b* and 359*b* in the specific region 386*b*, respectively, extend continuously in the axial direction.

Figure 25:
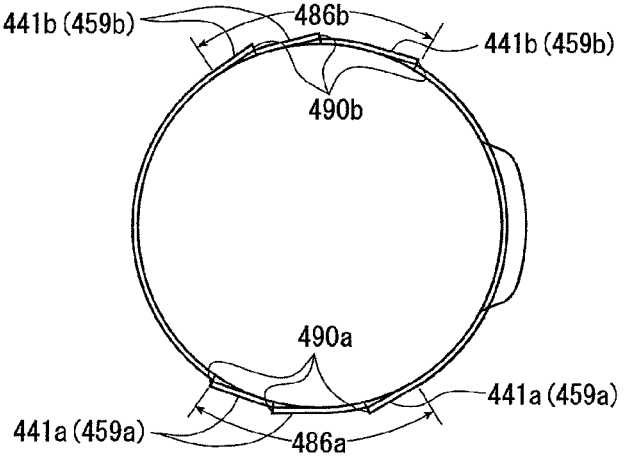
FIG. 25 is a plan view showing a state where the lid body is mounted, as required, on the inside plug, showing another modification of the shape deformation portion.

FIG. 25 shows another modification of the shape deformation portion. In the modification shown in FIG. 25, three flat surfaces 441*a* extending in the axial direction are formed on the outer peripheral surface of amounting wall below an annular shoulder surface in a specific region 486*a*, and three flat surfaces 459*a* extending correspondingly in the axial direction are formed on the outer peripheral surface of a fitting wall in the specific region 486*a*. In a specific region 486*b*, three flat surfaces 441*b* extending in the axial direction are formed on the outer peripheral surface of the mounting wall below the annular shoulder surface, and three flat surfaces 459*b* extending correspondingly in the axial direction are formed on the outer peripheral surface of the fitting wall. On the flat surfaces 441*a*, 459*a* and the flat surfaces 441*b*, 459*b*, respectively, additional flat surfaces 490*a* and 490*b* extending radially inwardly are annexed at the upstream side edge in the aforementioned predetermined direction (counterclockwise direction in FIG. 25). Such additional flat surfaces 490*a* and 490*b* provide surfaces for engagement with fingers when the lid body is rotated relative to the inside plug in the predetermined direction.

In the embodiments illustrated in FIGS. 16 to 25, the shape deformation portions are arranged at the specific site of the fitting wall (and skirt wall) of the lid body and at the specific site of the mounting wall. Instead, however, suitable characters or patterns can be printed, if desired, at the specific site of the fitting wall (and skirt wall) of the lid body and the specific site of the mounting wall.

EXPLANATIONS OF LETTERS OR NUMERALS

2: Inside plug
4: Lid body
6: Closing wall
8: Mounting wall
18: Breakable thin-walled line
18*a:* Breakable start end portion of breakable thin-walled line
18*b:* Outer arcuate portion of breakable thin-walled line
18*c:* Inner arcuate portion of breakable thin-walled line
20: Deformation region
22: Locked means
22*a:* Strut portion of locked means
22*b:* Overhanging beam portion of locked means
32: Locking projection
34: Ratchet pawl
36: Ratchet pawl
42: Body portion of lid body
43: Outer lid of lid body
44: Covering wall
46: Fitting wall
48: Discharge opening
56: Locking projection
58: Locking means
58*a:* Suspending pillar portion
58*b:* Protrusion
86: Mouth neck of container
90: Pass-through opening
102: Inside plug
118: Breakable thin-walled line
118*a:* Breakable start end portion of breakable thin-walled line
118*b:* Outer arcuate portion of breakable thin-walled line
118*c:* Inner arcuate portion of breakable thin-walled line
120: Deformation region
202: Inside plug
204: Lid body
302: Inside plug
304: Lid body

The invention claimed is:

1. A container lid comprising a synthetic resin inside plug to be mounted on a mouth neck of a container, and a synthetic resin lid body to be mounted on the inside plug, wherein the inside plug includes a circular closing wall, and a cylindrical mounting wall connected to an outer peripheral edge of the closing wall, and the mounting wall is fitted to an outer peripheral surface of the mouth neck of the container, whereby the inside plug is mounted on the mouth neck of the container, and the closing wall closes the mouth neck of the container, the lid body includes a circular covering wall, and a cylindrical fitting wall connected to an outer peripheral edge of the covering wall, and the fitting wall is fitted to an outer peripheral surface of the mounting wall of the inside plug, whereby the lid body is rotatably mounted on the inside plug, and the covering wall is located above the closing wall of the inside plug, at least one breakable thin-walled line is formed in the closing wall of the inside plug, the breakable thin-walled line has an outer arcuate portion extending from a breakage start end portion, and an inner arcuate portion extending from the breakage start end portion, and an arcuate deformation region is defined between the outer arcuate portion and the inner arcuate portion, locked element is annexed to the deformation region, at least one discharge opening is formed in the covering wall of the lid body, and locking element collaborating with the locked element is disposed on a lower surface of the covering wall, with the lid body being mounted on the inside plug, the locking element is located upstream of the locked element as viewed in a predetermined direction; when the lid body is rotated in the predetermined direction relative to the inside plug, the locking element is locked to the locked element; and when the lid body is rotated further in the predetermined direction relative to the inside plug, a force is exerted on the deformation region via the locking element and the locked element, so that the breakable thin-walled line of the inside plug is broken and the deformation region is deformed, whereby a pass-through opening is formed in the closing wall of the inside plug;

wherein two or three of the breakable thin-walled lines are formed at equal intervals in a circumferential direction in the closing wall of the inside plug, and two or three of the deformation regions are defined at equal intervals in the circumferential direction, the locked element is composed of a locked piece extending out upwardly from an upstream end part of the deformation region, as viewed in the predetermined direction, and then extending inwardly in a radial direction, each of the locking element is composed of a locking piece extending downwardly from the lower surface of the covering wall, and then extending in the predetermined direction, each of the locked pieces is composed of a strut portion extending out upwardly vertically from the upstream end part of the deformation region as viewed in the predetermined direction, and an overhanging beam portion extending horizontally in a radially inward direction from an upper end part of the strut portion, and radially inward ends of the overhanging beam portions are connected to each other.

2. The container lid according to claim 1, wherein a common strut extending out upwardly from a center of an upper surface of the closing wall of the inside plug is disposed in the closing wall of the inside plug, and the radially inward ends of the overhanging beam portions of the respective locked pieces are connected to each other via the common strut.

3. The container lid according to claim 1, wherein each of the locking pieces is composed of a suspending pillar portion extending downwardly from the lower surface of the covering wall, and a protrusion extending arcuately in the predetermined direction from a lower end part of the suspending pillar portion.

4. The container lid according to claim 3, wherein two or three of the discharge openings are formed in the covering wall of the lid body in correspondence with the deformation regions and, in a plan view, each of the protrusions is located as a whole within the discharge opening.

5. The container lid according to claim 1, wherein at least one positioning groove is formed in one of the outer peripheral surface of the mounting wall of the inside plug and an inner peripheral surface of the fitting wall of the lid body, and at least one positioning projection is formed in another of the outer peripheral surface of the mounting wall of the inside plug and the inner peripheral surface of the fitting wall of the lid body, and the lid body is mounted on the inside plug, with the positioning projection being advanced into the positioning groove, whereby a relative angular position of the lid body with respect to the inside plug is regulated.

6. The container lid according to claim 1, wherein the outer arcuate portion and the inner arcuate portion of the breakable thin-walled line formed in the closing wall of the inside plug extend counterclockwise from the breakage start end portion as viewed from above, and the predetermined direction is a counterclockwise direction as viewed from above.

7. The container lid according to claim 1, wherein rotation inhibiting elements collaborating with each other to inhibit the lid body from rotating relative to the inside plug in a direction opposite to the predetermined direction are arranged in the inside plug and the lid body.

8. The container lid according to claim 1, wherein when the lid body is rotated relative to the inside plug in the predetermined direction by an angle $\alpha$, which is 50 to 60 degrees, the locking element is locked to the locked element, and return rotation inhibiting element, which, when the lid body is rotated relative to the inside plug by an angle $\beta$ being 0 to 20 degrees smaller than the angle $\alpha$ (0 degrees$\leq\alpha-\beta\leq$20 degrees), collaborate with each other to inhibit the lid body from rotating relative to the inside plug in a direction opposite to the predetermined direction, are arranged in the inside plug and the lid body.

9. The container lid according to claim 1, wherein rotation restricting elements, which collaborate with each other to restrict rotation of the lid body relative to the inside plug in the predetermined direction to an angle $\gamma$ being 300 to 320 degrees, are arranged in the inside plug and the lid body.

10. The container lid according to claim 9, wherein reverse rotation inhibiting elements, which, when the lid body is rotated relative to the inside plug in the predetermined direction by the angle γ, collaborate with each other to inhibit the lid body from rotating relative to the inside plug in a direction opposite to the predetermined direction, are arranged in the inside plug and the lid body.

11. The container lid according to claim 1, wherein at least an upstream part of the deformation region as viewed in the predetermined direction is inclined gradually upwardly in an upstream direction.

12. The container lid according to claim 11, wherein central main portion of the closing wall, except at least the upstream part of the deformation region and a neighborhood thereof, extends horizontally, the deformation region extends horizontally from a downstream end thereof in an upstream direction, as viewed in the predetermined direction, along a horizontally extending site of the central main portion, and then extends in the upstream direction upwardly obliquely up to an upstream end thereof, and a rising surface extending vertically adjacent to the breakage start end portion and upstream parts of the outer arcuate portion and the inner arcuate portion of the breakable thin-walled line defining the deformation region is formed in the central main portion of the closing wall.

13. The container lid according to claim 1, wherein an annular shoulder surface facing upward is formed in the mounting wall of the inside plug, the outer peripheral surface of the mounting wall located below the annular shoulder surface is located radially outwardly of the outer peripheral surface located above the annular shoulder surface, and the fitting wall of the lid body is fitted to a part of the mounting wall above the annular shoulder surface, corresponding shape deformation portions and/or prints are arranged in at least a lower part of the outer peripheral surface of the fitting wall of the lid body and on the outer peripheral surface of the mounting wall below the annular shoulder surface, and a relative relationship between the corresponding shape deformation portions or prints, with the lid body being mounted on the inside plug as required, is changed when the lid body is rotated relative to the inside plug, whereby it is clearly indicated that the lid body has been rotated relative to the inside plug.

14. The container lid according to claim 13, wherein in a state where the lid body has been mounted on the inside plug as required, at least the lower part of the outer peripheral surface of the fitting wall of the lid body and the outer peripheral surface of the mounting wall of the inside plug below the annular shoulder surface are nearly flush with each other.

15. The container lid according to claim 13, wherein an outer lid is coupled via hinge element to an upper end part of the outer peripheral surface of the fitting wall of the lid body so as to be pivotable between a closed position where the covering wall of the lid body is covered and an open position where the covering wall of the lid body is exposed, and at least one ridge, which extends continuously in an axial direction so as to span between at least the lower part of the outer peripheral surface of the fitting wall and the outer peripheral surface of the mounting wall below the annular shoulder surface to constitute the corresponding shape deformation portion, is arranged in each of two specific regions each having a width of 30 to 100 degrees in a circumferential direction about a circumferential center which is a site at an angular distance of 90 degrees on each of circumferentially opposite sides from a circumferential center of the hinge element.

16. The container lid according to claim 15, wherein the number and/or width of the ridges arranged in one of the two specific regions are different from the number and/or width of the ridges arranged in another of the two specific regions.

17. The container lid according to claim 13, wherein an outer lid is coupled via hinge element to an upper end part of the outer peripheral surface of the fitting wall of the lid body so as to be pivotable between a closed position where the covering wall of the lid body is covered and an open position where the covering wall of the lid body is exposed, and at least one flat surface, which extends continuously in an axial direction so as to span between the lower part of the outer peripheral surface of the fitting wall and the outer peripheral surface of the mounting wall below the annular shoulder surface to constitute the corresponding shape deformation portion, is arranged in each of two specific regions each having a width of 30 to 100 degrees in a circumferential direction about a circumferential center which is a site at an angular distance of 90 degrees on each of circumferentially opposite sides from a circumferential center of the hinge element.

18. The container lid according to claim 17, wherein the number and/or width of the flat surfaces arranged in one of the two specific regions are different from the number and/or width of the flat surfaces arranged in another of the two specific regions.

19. The container lid according to claim 17, wherein an additional flat surface extending radially inwardly from an upstream side edge of the flat surface, as viewed in the predetermined direction, is annexed to the upstream side edge of the flat surface.

* * * * *